US007090108B2

(12) United States Patent
Boenig et al.

(10) Patent No.: US 7,090,108 B2
(45) Date of Patent: Aug. 15, 2006

(54) EXPLOSION POWER-OPERATED SETTING TOOL

(75) Inventors: Stefan Boenig, Achberg-Esseratsweiler (DE); Kersten Nilsson-Otto, Barsinghausen (DE)

(73) Assignee: Hilti Aktiengesellschaft, Schhan (LI)

( * ) Notice: Subject to any disclaimer, the term of this patent is extended or adjusted under 35 U.S.C. 154(b) by 0 days.

(21) Appl. No.: 11/011,824

(22) Filed: Dec. 14, 2004

(65) Prior Publication Data

US 2005/0167462 A1 Aug. 4, 2005

(30) Foreign Application Priority Data

Dec. 15, 2003 (DE) ..... 103 58 578

(51) Int. Cl.
*B25C 1/14* (2006.01)

(52) U.S. Cl. ..... 227/10; 227/156

(58) Field of Classification Search ..... 227/4, 227/7, 10, 120, 134, 156; 267/137, 139, 267/140, 155
See application file for complete search history.

(56) References Cited

U.S. PATENT DOCUMENTS 3,331,546 A * 7/1967 Brunelle ..... 227/10
3,565,313 A * 2/1971 Seghezzi et al. ..... 227/10
3,820,703 A * 6/1974 Rangger ..... 227/10
4,122,987 A * 10/1978 Jochum et al. ..... 227/10
4,134,527 A * 1/1979 Termet ..... 227/10
4,374,567 A * 2/1983 Combette et al. ..... 227/10
4,941,391 A * 7/1990 Ehmig et al. ..... 89/1.14
5,901,894 A * 5/1999 Melocco ..... 227/10
6,029,878 A * 2/2000 Pfister et al. ..... 227/10
6,053,388 A * 4/2000 Pfister et al. ..... 227/10
6,123,243 A * 9/2000 Pfister et al. ..... 227/10
6,938,811 B1 * 9/2005 Ehmig et al. ..... 227/10

* cited by examiner

*Primary Examiner*—Stephen F. Gerrity
*Assistant Examiner*—Paul Durand
(74) *Attorney, Agent, or Firm*—Abelman, Frayne & Schwab

(57) ABSTRACT

An explosion power-operated setting tool includes a setting piston (15) for driving in fastening elements in constructional components, and a resetting device (30) having a lever-shaped resetting member (31) for returning the setting piston (15) from its end position (26) into its initial position (25), a bearing section (43) for supporting the lever-shaped resetting member (31), and a damping member (43) for damping the lever-shaped resetting member (31) upon the resetting member (31) impacting the bearing section (43), with the damping member (44) having a bearing surface (46) which the rear surface (36) of the lever-shaped resetting member (31) abuts and which has a profile substantially corresponding to a profile of the rear surface (36) of the lever-shaped resetting member (31).

3 Claims, 2 Drawing Sheets

EXPLOSION POWER-OPERATED SETTING TOOL

BACKGROUND OF THE INVENTION

1. Field of the Invention

The present invention relates to an explosion power-operated setting tool for driving fastening elements in a structural component and including a housing; a piston guide arranged, at least partially, in the housing and having a guide chamber; a setting piston displaceable arranged in the guide chamber of the piston guide, and a resetting device including a lever-shaped resetting member for returning the setting piston from its end position facing in the setting direction in its initial position and having a rear surface, a bearing section for supporting the resetting member, and a damping member adjoining the bearing section for damping the resetting member upon the resetting member impacting the bearing section and having a bearing surface which the rear surface of the resetting member abuts.

2. Description of the Prior Art

Setting Tools of the type described above are driven, e.g., with solid fuels in form of cartridges, which are filled with an explosive powder, or in form of pellets which are formed of a compressed explosive powder. The setting tools includes a housing, a piston guide arranged, at least partially in the housing, and a setting piston displaceably arranged in the piston guide. In these setting tools, the setting piston is driven by combustion gases of the fuel. With the setting piston, fastening elements such as nails, bolts, etc. are driven in constructional components. After completion of each setting process, the setting piston should return into its initial position.

German Publication DE-19749027A1 discloses a hand-held, explosive powder charge-operated setting tool which includes a setting piston resetting device. The resetting of the setting piston is effected with a spring-biased, lever-shaped resetting member which forms part of the resetting device and which pivots relative to the housing in a plane extending in the setting direction. The lever-shaped resetting member projects through a side opening of the piston guide into the interior of the piston guide and cooperates therewith a driving surface of the setting piston facing in the setting direction. The resetting member pivots about a rotational axle supported in the setting tool housing. The biasing spring, which cooperates with the resetting member is supported, on one hand against the housing and, on the other hand, against a stop or rear surface of the lever-shaped resetting member. Upon displacement of the setting piston in the setting direction, the lever-shaped resetting member pivots up to a stop on a damping member and, thereby, the spring becomes preloaded. After the completion of a setting process, the spring is relaxed, providing for pivoting of the resetting member in a direction opposite to the setting direction until the setting piston is returned to its initial position.

The drawback of the known setting tool consists in that the lever-shaped resetting member is subjected to strong bending forces upon impacting the damping member. This accelerates the material fatigue and brings into open the defects of the lever-shaped resetting member.

Accordingly, an object of the present invention is a setting tool of the type described and in which the foregoing drawback is eliminated, and the resetting device has an improved service life.

SUMMARY OF THE INVENTION

This and other objects of the present invention, which will become apparent hereinafter, are achieved, by providing a setting tool including a resetting device with a damping member a bearing surface of which cooperates with a rear surface of the lever-shaped resetting member and has a profile substantially corresponding to the profile of the rear surface of the lever-shaped resetting member. With this, the lengths of both surfaces are substantially the same. These measures insures that the rear surface of the lever-shaped resetting member almost completely, formlockingly abuts the bearing surface of the damping element when the resetting member is driven by the setting piston and impacts the damping member. Thereby, bending stresses which can lead to an increased wear and/or to material fatigue, are eliminated. With substantially corresponding profiles of the bearing surface of the damping member and the rear surface of the lever-shaped resetting member, the contact area between the rear surface and the bearing surface amounts to at least about 60%, preferably 70–100% of the rear surface of the resetting member, not counting the region of the rear surface about the pivot axle.

Advantageously, the shape and size of the member are adapted to profile and length of the rear surface of the lever-shaped resetting member. This permits to achieve a uniform damping along the rear surface of the lever-shaped resetting member.

Advantageously, the bearing surface of the damping member has, with respect to the lever-shaped resetting member, a concave profile. The concave profile of the bearing surface advantageously cooperates with a corresponding convex profile of the rear surface of the lever-shaped resetting member. In this case, a very good kinematics of the resetting member/damping member system is achieved, together with optimal damping.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
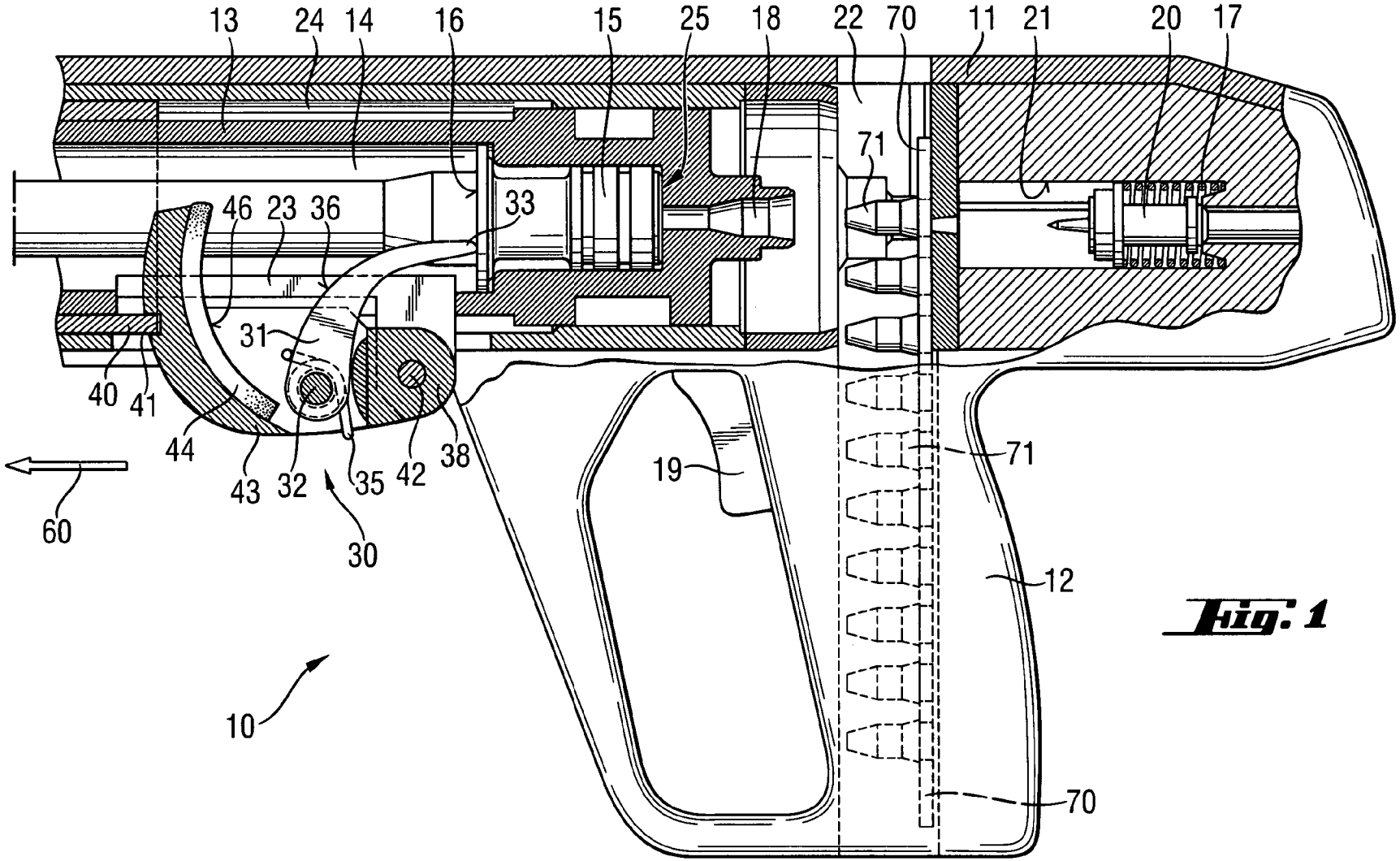
FIG. 1 a side, partially cross-sectional view of a setting tool according to the present invention with a setting piston in its first position.
Figure 2:
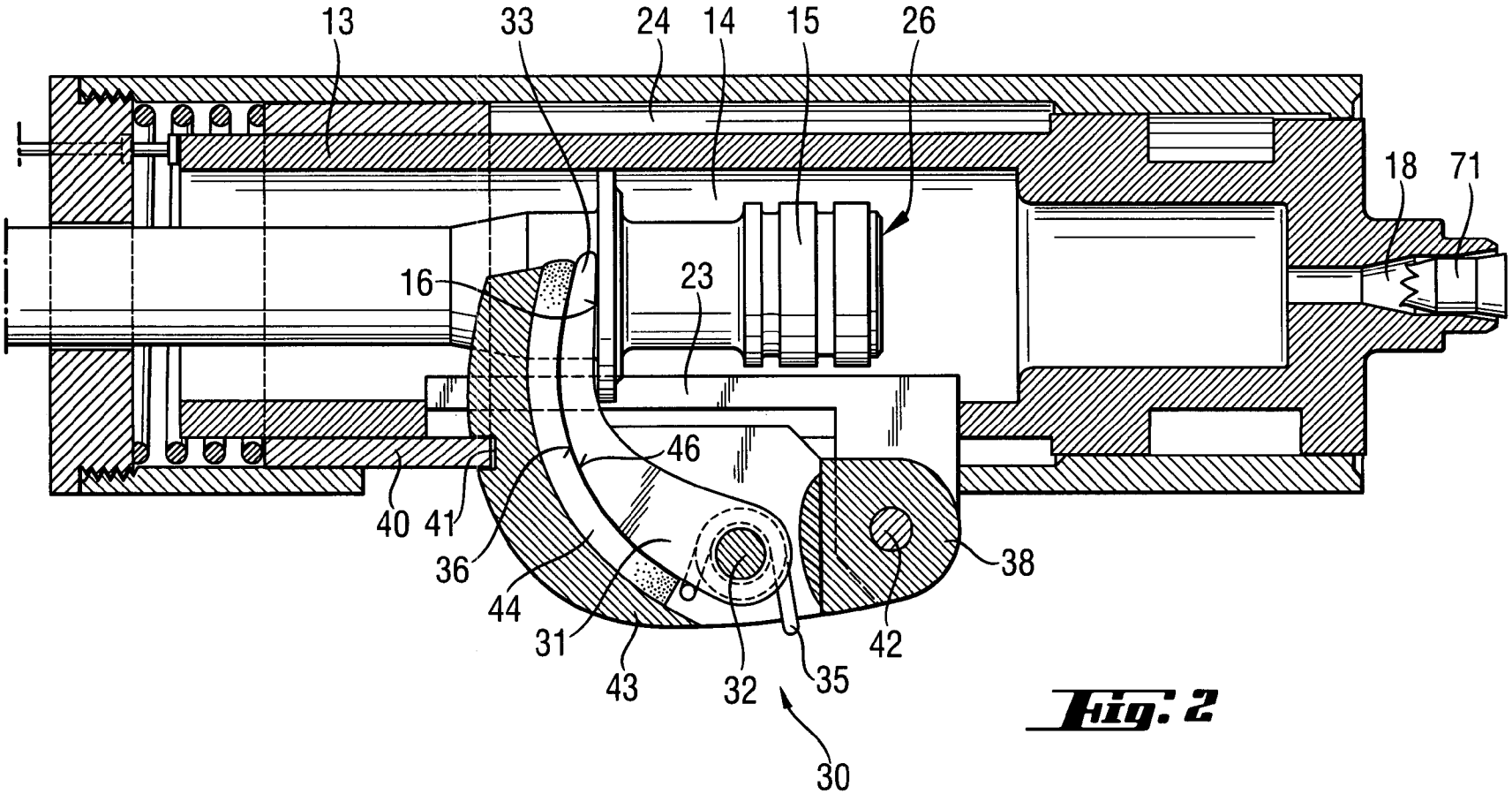
FIG. 2 a cross-sectional view of a detail of the setting tool shown in FIG. 1 with the setting piston in its second piston.

An explosion power-operated setting tool 10 according to the present invention, which is shown in FIGS. 1–2, has a one- or multi-part housing 11 having a sleeve-shaped receiving chamber 24, a piston guide 13 displaceably arranged in the receiving chamber 24, and a spring that provides for support of the piston guide 13 in the housing 11 and that biases the piston guide 13 in a setting direction 60. A setting piston 15 is arranged in the guide chamber 14 of the piston guide 13 for axial displacement therein. The setting piston 15 is driven by a propellant, e.g., such as a cartridge 71 which is placed in the cartridge chamber 18. An ignition element such as, e.g., a firing pin 20, which is displaceable in a firing pin guide 21 and is biased by a spring 17, serves for ignition of a cartridge 71 to be located in the cartridge chamber 18. The cartridges 71 can be stored in a propellant magazine strip 70 displaceable in a guide channel 22.

In the embodiment shown in the drawings, a handle 12 is provided on the housing 11. The handle 12 carries an actuation switch 19 for initiating a setting process by a user of the setting tool 10.

The setting tool 10 further includes a resetting device, which is generally designated with a reference numeral 30, for the setting piston 15. The resetting device 30 includes a lever-shaped resetting member 31, which is formed as a pivot lever pivotally supported on a pivot axle 32 provided on a support 38. The support 38, in turn, is supported on the piston guide 13 for pivotal movement about a pivot axis 42. In FIG. 1, the support 38 is held in its operational position, in which the resetting member 31 projects into the piston guide 13, by a locking member 40 that engages in a locking recess 41 provided in the support 38. The resetting member 31 extends through an opening 23 provided in the piston guide 13, with the free end 33 of the resetting member 31 engaging a driving surface 16 of the setting piston 15 facing in a setting direction 60. A spring 35, which is formed as a torsion spring, biases the lever-shaped resetting member 31 into engagement with the driving surface 16 of the setting piston 15. The support 38 has a bearing section 43 which supports a damping member 44 for the lever-shaped resetting member 31. The damping member 44 has a bearing surface 46 having a profile corresponding to the profile of a rear surface 36 of the lever-shaped resetting member 31 facing in the setting direction 60.

For replacing the setting piston 15, the support 38 can be pivoted out with the respect to the setting tool 10 by release of the locking connection between the locking member 40 and the locking recess 41 in the support 38.

In the initial position of the setting tool 10 shown in FIG. 1, the setting piston 15 is located at an end of the piston guide 13 adjacent to the cartridge chamber 18, and is held in this position, which is designated with a reference numeral 25, with the resetting member 31.

When a cartridge 71 in the cartridge chamber 18 is ignited with the firing pin 20 or another ignition element, the piston 15 is displaced into its end position 26 shown in FIG. 2. The setting piston 15 entrains the lever-shaped resetting member 31, which preloads the spring 35, so that it is capable of returning the setting piston 15 into its initial piston. Upon pivotal movement of the resetting member 31, its rear surface 36 formlocking abuts the bearing surface 46 of the damping member 44 which is supported on a bearing section 43 of the support 38. Thereby, unfavorable bending stresses in the resetting member 31 are prevented.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An explosion-power operated setting tool , for driving fastening elements in a structural component, comprising a housing (11); a piston guide (13) arranged, at least partially, in the housing (10) and having a guide chamber (14); a setting piston (16) displaceable arranged in the guide chamber (14) of the piston guide (13); and a resetting device (30) including a lever-shaped resetting member (31) for returning the setting piston (15) from an end position (26) thereof facing in the setting direction (60) in an initial position (25) thereof and having a rear surface (36), a bearing section (43) for supporting the resetting member (31), and a damping member (44) adjoining the bearing section (43) for damping the resetting member (31) upon the resetting member (31) impacting the bearing section (43) and having a bearing surface (46) which the rear surface (36) of the resetting member (31) abuts, the bearing surface (46) of the damping member (44) having a profile substantially corresponding to a profile of the rear surface (36) of the resetting member (31), wherein the bearing surface (46) of the damping member (44) has, with respect to the lever-shaped resetting member (31), a concave profile.

2. A setting tool according to claim 1, wherein shape and size of the damping member (44) correspond to the profile and length of the rear surface (36) of the lever-shaped resetting member (31).

3. A setting tool according to claim 1, wherein the rear surface (36) of the lever-shaped resetting member (31) has a convex profile corresponding to the concave profile of the bearing surface (46) of the damping member (44).

* * * * *